United States Patent [19]

Burke

[11] 3,996,633

[45] Dec. 14, 1976

[54] WATERBED BEDCLOTHES

[76] Inventor: Carol E. Burke, 13825 E. 35th Court, Independence, Mo. 64055

[22] Filed: Nov. 24, 1975

[21] Appl. No.: 634,822

[52] U.S. Cl. ..... 5/334 C; 5/370

[51] Int. Cl.[2] ..... A47G 9/00

[58] Field of Search ..... 5/334 R, 334 C, 348 WB, 5/335, 370

[56] References Cited

UNITED STATES PATENTS

| | | | |
|---|---|---|---|
| 2,516,363 | 7/1950 | Block et al. | 5/334 C |
| 2,624,893 | 1/1953 | Harris | 5/334 C |
| 2,630,588 | 3/1953 | Levin | 5/334 C |
| 2,662,234 | 12/1953 | Citron | 5/334 C |
| 3,066,321 | 12/1962 | Kintner | 5/334 C |
| 3,838,470 | 10/1974 | May | 5/370 |

*Primary Examiner*—Paul R. Gilliam
*Assistant Examiner*—Andrew M. Calvert
*Attorney, Agent, or Firm*—Fishburn, Gold & Litman

[57] ABSTRACT

Fitted bedclothes for rectangular waterbeds comprising a flat substantially rectangular panel member overlying an upper surface of the mattress and an upper portion of the mattress sides. A right-triangular pocket member is connected to at least two panel member corners, forming pockets therebetween and being adapted for receiving a waterbed mattress corner therein. An extensible portion of a free edge of each pocket member resiliently engages a lower corner surface of said mattress, opposingly and diagonally pulling the bedclothes taut over the mattress.

6 Claims, 4 Drawing Figures

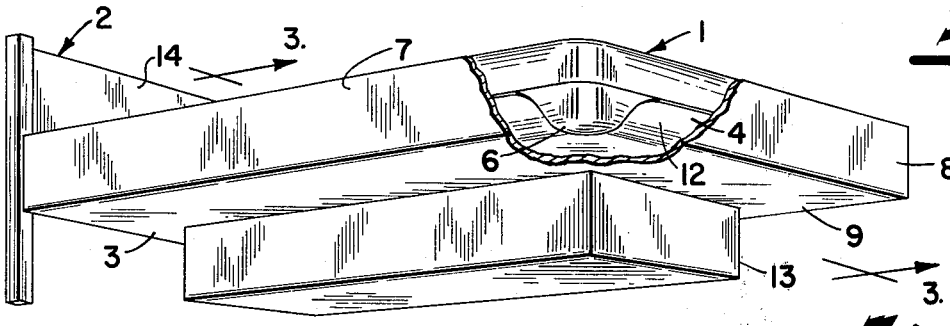
Fig. 1.
Fig. 2.
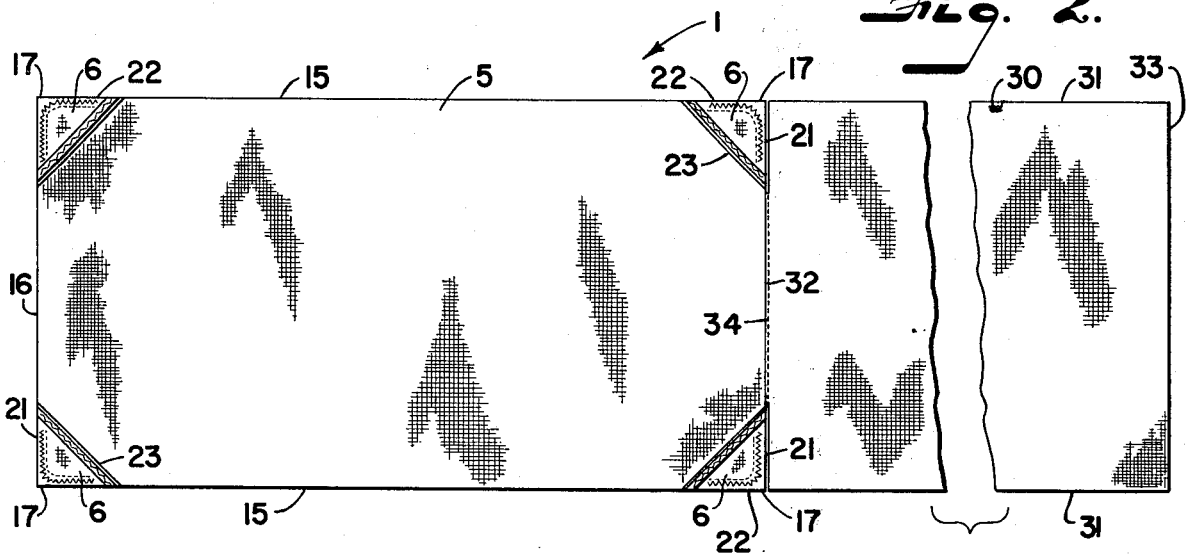
Fig. 4.
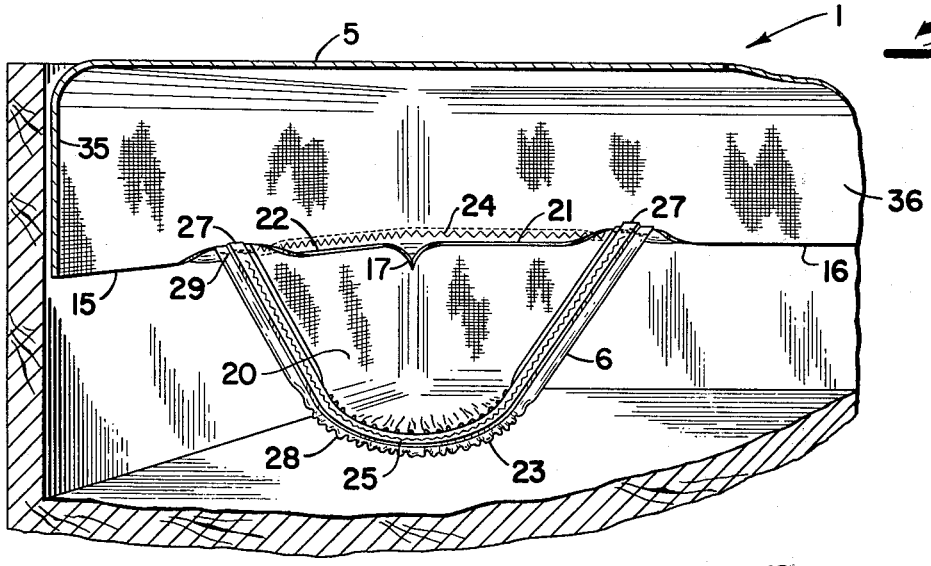
Fig. 3.
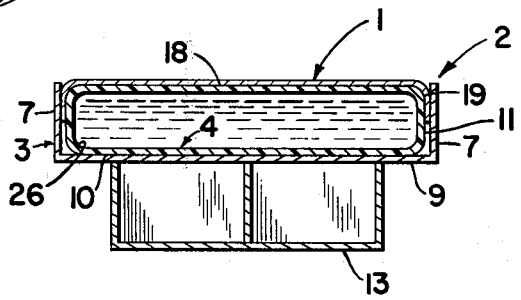

WATERBED BEDCLOTHES

Fitted bedclothes, when properly adjusted on a mattress, present a neat appearance and represent a substantial labor saving convenience in the daily chore of making up a bed between uses and/or linen changes. In addition, fitted bedclothes prevent the sleeper from disturbing the bedding to such an uncomfortable extent that his slumber is interrupted. Waterbed mattreses are far less rigid or firm than conventional innerspring mattresses, and therefore react much more violently to sleeper movement, thereby causing considerable bedclothes disturbance, such that daily rearrangement is inevitably required.

In fitted bedclothes for conventional mattresses, it is common to have sheet side portions extend under the mattress and thereby necessitate the lifting of a substantial portion of the mattress to fit same into the fitted bedding. Because waterbeds are extremely heavy, on the order of 45 pounds per square foot of mattress, such lifting is, at best, extremely strenuous, and particularly inefficient for chambermaids or other individuals charged with changing the bed linen in the numerous rooms of a hotel or motel.

This invention relates to mattress bedclothes and in particular, to fitted bedclothes for rectangular waterbeds.

The principal objects of the present invention are: to provide neat and comfortable fitted bedclothes for rectangular waterbeds; to provide such fitted bedclothes comprising a rectangular flat panel member including triangular pocket members connected to at least two corners thereof, forming pockets adapted for receiving the corners of the waterbed mattress for removably and tautly attaching said bedclothes to the mattress; to provide fitted bedclothes wherein the side and end edges of the flat panel member overlie an upper portion of the mattress sides and ends, for the easy fitting of the bedclothes to the mattress; to provide such fitted bedclothes wherein an elastic strip is connected to the free edge of said pocket member for the secure, but removable attachment of the bedclothes to the waterbed mattress; to provide such fitted bedclothes wherein the elastic strip is in an extended condition when connected to the pocket such that said panel member is pulled taut over the mattress; to provide such fitted bedclothes wherein a substantially rectangular flat top sheet member overlies the panel member and is connected thereto along a foot end edge of the sheet and top sheet members respectively; and to provide such fitted bedclothes which are economical to manufacture, efficient in use and capable of long life and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include exemplary embodiments of the present invention and illustrate various objects and features of this apparatus.

FIG. 1 is a perspective view of a waterbed having a corner portion thereof broken away to show the fitted bedclothes and mattress therefor.

FIG. 2 is a plan view of a fitted bedclothes blank particularly showing top and bottom sheet members and the interconnection thereof.

FIG. 3 is a reduced vertical cross-sectional view of the waterbed frame, mattress and fitted bedclothes therefor taken along a line 3—3, FIG. 1.

FIG. 4 is an enlarged fragmentary perspective view of the frame and bedclothes corner pocket portion as viewed from the inside of the bedding.

Referring more in detail to the drawings:

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

The reference numeral 1 generally designates fitted bedclothes for rectangular waterbeds 2, such as mattress covers, blankets, and the illustrated mattress sheet. The waterbed 2 includes a rectangular, peripheral frame 3 within which is disposed a water-filled liner or mattress 4. A flat sheet or panel member 5 is provided with triangular pocket members 6 connected to at least two sheet member corners, forming pockets adapted for receiving a waterbed mattress corner therein.

The waterbed 2 generally comprises interconnected side rails 7, end rails 8 and bottom member 9 which form a rectangular structure in which the water-filled mattress 4 is contained. The lower surface of the mattress 10 and the mattress side and end portions 11 and 12 respectively, generally conform to the respective frame members 9, 7 and 8. A pedestal 13 is provided to support the frame 3 above the floor surface and a decorative board member 14 is provided at the head of the bed.

The flat sheet or panel member 5 is substantially rectangular in shape, having side edges 15, end edges 16 and corners 17. A major portion of the panel member 5 overlies and covers the upper mattress surface 18. However, unlike conventional fitted sheets, which extend over the mattress sides and under the mattress lower surface, the panel member side and end edges 15 and 16 overlie only an upper portion 19 of the mattress side and end portions 11 and 12, such that the mattress need not be lifted prior to removing or replacing the fitted sheet. The upper portion 19, as well as the corresponding panel member sides and ends 35 and 36, are preferably of a width in the nature of twice the thickness of the mattress 4. The panel member 5 is preferably constructed of a single panel of commercially available and suitable material, such as cotton and/or various synthetic fibers.

A triangular pocket member 6 is constructed of flexible sheet material and is connected to at least two panel member corners 17 thereby forming pockets 20 for receiving the corners of the waterbed mattress 4 therein. The pocket member 6 includes perpendicularly disposed first edge 21 and second edge 22 respectively connected to the panel member end edge 16 and side edge 15. A third or free edge 23 of the pocket member 6 is disposed obliquely of the pocket member first and second edges and has a longitudinally extensible portion thereof adapted for resilient engagement with a lower corner surface of the mattress 4. In the illustrated structure, a pocket member 6 is connected to each panel member corner 17, and the first and second pocket member edges 21 and 22 are substantially equal in length. Edges 21 and 22 are also sewn to the panel member end and side edges 16 and 15 along hem member 24 and preferably are each of a length in the nature of twice the thickness of mattress 4. The pocket member 6 is preferably constructed of a single panel of suitable fabric such as cotton and/or various synthetic materials.

The pocket member extensible portion is illustrated as a strip of elastic material 25 connected to the pocket member free edge 23 for resiliently engaging a lower corner surface 26 of the mattress 4. The ends 27 of the elastic strip 25 are connected to the sheet member end and side edges 16 and 15 respectively, as well as hem member 24. In the illustrated structure, the elastic strip 25 is in an extended condition when connected to the pocket member free edge 23 and sheet member end and side edges 16 and 15 respectively, such that the sheet member 5 is opposingly and diagonally pulled taut over the upper mattress surface 18 by the elastic strips. The elastic strip 25 and pocket member free edge 23 are interconnected intermittently along their length such as by diagonal stitches, whereby, as the elastic strip relaxes from a fully extended condition to a partially extended and/or fully relaxed position, the excess pocket material is gathered into folds 28 to facilitate the secure engagement of the bedclothes 1 with waterbed mattress 4. In the illustrated structure, the elastic strip ends 27 are sewn to the sheet member end and side edges 16 and 15 by a plurality of rows of stitches 29 to reinforce their interconnection.

Another embodiment of the present invention, as illustrated in FIG. 2, includes a second, substantially rectangular flat sheet 30 having side edges 31, foot end edge 32 and head end edge 33. The second sheet 30 is connected to the panel member 5 along a second hem member 34 at the foot of said panel member and mattress 4. The second sheet 30 overlies the panel member 5, thereby providing top and bottom sheets securely but removably attached to the waterbed mattress 4.

In use, the sheet or cover may be easily but securely connected to the mattress 4 so as to provide neat and comfortable bedclothes therefor. The user places the cover 1 overlying upper mattress surface 18 with the sheet member side and end edges 15 and 16 extending over upper mattress surface 18. The pocket members 6 are slidingly inserted between the frame 3 and the mattress 4 at the corners thereof and are pulled under a lower corner surface 26 of the mattress 4. The resiliency of elastic strip 25 urges sheet member side and end edges 15 and 16 downwardly between the mattress and frame as well as opposingly tightening the major portion of the sheet member over the upper mattress surface 18, removing wrinkles so as to provide neat and comfortable bedclothes for the mattress 4. Should the sheet 1 shrink as a result of laundering, the resilient pocket members permit the bedclothes to retain their original neat appearance and usefulness.

It is to understood that while I have illustrated and described certain forms of my invention, it is not to be limited to the specific forms or arrangement of parts herein described and shown.

What I claim and desire to secure by Letters Patent is:

1. A fitted mattress cover for rectangular waterbed mattresses having spaced upper, lower, side and end surfaces and corners, said cover comprising:

a. a substantially rectangular flat panel member having upper, side and end surfaces, side edges, end edges, and corners;

b. said panel member being adapted to overlie a mattress upper surface with the side and end surfaces of the panel member overlying an upper portion of the surfaces of the mattress sides and end respectively;

c. a triangular pocket member at each corner of the panel member and connected to side and end edges of the panel member forming pockets for receiving a waterbed mattress corner therein, said pocket member having first and second edges and a free edge, said first and second edges being respectively connected to one of said panel member end edges and one of said panel member side edges whereby said first and second edges extend from a respective corner of the panel member;

d. a portion of said pocket member being longitudinally extensible and adapted for resilient engagement with a lower corner surface of said mattress;

e. an elastic strip connected to said pocket member free edge, said elastic strip having ends connected to said panel member one end edge and one side edge respectively; and f. said elastic strip being in an extended condition when connected to said pocket member free edge and said panel member one end edge and one side edge, whereby the pockets cooperate with the water in the mattress to retain the engagement of the pocket on the mattress corners and thereby retain the panel members in covering relation to the upper surface of the mattress.

2. A fitted mattress cover as set forth in claim 1 including:

a. a substantially rectangular, flat top sheet member overlying said panel member and connected thereto only along a foot end edge of said panel and top sheet members respectively; and b. said panel, top sheet, and pocket members each being constructed of a single panel of fabric.

3. A fitted mattress cover as set forth in claim 1 wherein:

a. said mattress upper and lower surfaces define therebetween a mattress thickness;

b. said panel member side and end surfaces, which overlie said upper portions of the sides and ends of the mattress, have a width in the nature of one half of the thickness of said mattress; and c. said pocket member first and second edges respectively have a substantially equal length, said length being in the nature of twice the thickness of said mattress.

4. A fitted mattress cover as set forth in claim 1 wherein:

a. said pocket member first and second edges are sewn to said panel member one end edge and one side edge;

b. said elastic strip is sewn to said pocket member free edge with a diagonal stitching for facilitating resilient engagement of said sheet with said mattress; and c. said elastic strip ends are sewn to said panel member one end edge and one side edge by a plurality of rows of stitches to form a reinforced interconnection.

5. In combination, a waterbed mattress and a fitted cover therefor, said combination comprising:

a. a substantially rectangular waterbed mattress having upper, lower, side and end surfaces, a depth between said upper and lower surfaces, and corners;

b. a substantially rectangular flat panel member having an upper surface, side edge, end edges, and corners;

c. said panel member upper surface overlying said mattress upper surface, said panel member side and end surfaces respectively overlying an upper portion of said side and end surfaces of said mattress;

d. a triangular pocket member connected to each panel member corner forming pockets each of which receive one of said mattress corners therein, said pocket member having perpendicular first and second edges and a free edge, said first and second edges being respectively connected to one of said panel member end edges and one of said panel member side edges whereby said first and second edges extend from a respective corner of the panel member;

e. a portion of said pocket member being longitudinally extensible and adapted for resilient engagement with a lower corner surface of said mattress;

f. said panel member side and end surfaces, which overlie said mattress side and end upper portion, have a width in the nature of one half of the thickness of said mattress;

g. said pocket member first and second edges respectively have a substantially equal length, said length being in the nature of twice the thickness of said mattress; and h. said pockets cooperating with water in the mattress to retain engagement of the pockets on the respective corners of the mattress and the panel member in covering relation to the upper surface of the mattress.

6. The combination as set forth in claim 5 including:

a. an elastic strip connected to said pocket member free edge; said elastic strip having ends respectively connected to said panel member one end edge and one side edge;

b. said elastic strip being in an extended condition when connected to said pocket member free edge and said panel member one end edge and one side edge, said elastic strip opposingly and diagonally pulling said panel member taut over the upper surface of said mattress; and c. said elastic strip being sewn to said pocket member free edge with a diagonal stitching for facilitating resilient engagement of said panel member with said mattress.

* * * * *